United States Patent [19]

Stary

[11] 4,138,245

[45] Feb. 6, 1979

[54] PROCESS FOR THE REMOVAL OF IMPURITIES FROM ALUMINUM MELTS

[75] Inventor: Rudolf Stary, Neuhausen am Rheinfall, Switzerland

[73] Assignee: Swiss Aluminium Ltd., Chippis, Switzerland

[21] Appl. No.: 853,196

[22] Filed: Nov. 21, 1977

[30] Foreign Application Priority Data

Dec. 21, 1976 [CH] Switzerland ..... 16074/76

[51] Int. Cl.[2] ..... C22B 21/00

[52] U.S. Cl. ..... 75/68 R; 75/93 R

[58] Field of Search ..... 75/68 R, 93 R

[56] References Cited

U.S. PATENT DOCUMENTS

| | | | |
|---|---|---|---|
| 3,753,690 | 8/1973 | Emley et al. | 75/68 R |
| 4,052,198 | 10/1977 | Yarwood | 75/68 R |

*Primary Examiner*—M. J. Andrews

*Attorney, Agent, or Firm*—Bachman & La Pointe

[57] ABSTRACT

Sodium is removed from aluminum by introducing a gaseous chlorinating agent for molten aluminum into a body of molten aluminum which has a content of sodium and passing the resulting mixture through a filter which carries a liquid metal chloride coating and which is able to chemisorb aluminum chloride which forms. As a result of this combined gas and filter treatment sodium chloride forms and adheres to the filter surface thus reducing the amount of sodium in the melt.

13 Claims, No Drawings

PROCESS FOR THE REMOVAL OF IMPURITIES FROM ALUMINUM MELTS

The invention concerns a process for the removal of impurities, in particular for the removal of sodium, from aluminum melts whereby the aluminum melt is treated with reactive chlorine as it passes through a filter bed.

It is known that the sodium content of aluminum melts can be reduced to a few ppm (parts per million) by treating the melt with reactive chlorine. The state of the art of processes using this method can be divided roughly into two groups.

1. The process proposed in German Pat. No. 1,912,887 can be looked on as being representative of the group of methods in which the molten metal is covered by a flux which is in the liquid state at the treatment temperature. During the course of the process, chlorine is introduced into the melt either periodically or continuously. The flux binds most of the sodium in the melt as sodium chloride. The fluxing agents which can be used for this are salt mixtures which contain alkali or alkali earth halides and also a complex salt such as sodium hexafluoroaluminate and similar compounds.

2. The process proposed in the U.S. Pat. No. 3,737,308 can be looked on as being representative of the second group in which the liquid aluminum is passed through a filter bed of refractory material through which chlorine gas is also passed.

The processes described at the beginning whereby the liquid aluminum is covered with a fluxing agent have the advantage that large quantities of sodium chloride can be taken up i.e. "stored" in the layer of flux.

On the other hand these processes have the disadvantage that at the treatment temperature the liquid flux is hydrolyzed by moisture in the air, with the result that smokey fumes can be seen to develop. These fumes consist mainly of hydrochloric acid and a mixture of finely divided aluminum oxide and hydroxide. There is also the possibility that the molten salt or its hydrolyzed products can diffuse into the lining of the furnace thus producing corrosion of the lining.

The use of filter beds ensures an optimum distribution of the chlorine introduced into the melt and produces therefore an optimum use of chlorine. Disadvantageous here is the low storage capacity of the refractory ceramic for the sodium chloride formed, which means that the NaCl accumulates on the surface of the melt and must be removed periodically.

The object of the invention is then to produce a process by which means the large capacity of the fluxing agent to store sodium chloride can be combined with the good distribution of the chlorine gas by a filter bed.

The object is fulfilled by way of the invention in that the filter bed is made out of a granular or foam-like material which can withstand the treatment temperature, the surface of which material is covered with a chloride containing salt or salt mixture which is in the liquid state at the treatment temperature and which is able to chemisorb aluminum chloride.

The sodium which is dissolved in the melt reacts with the chemisorbed aluminum chloride releasing aluminum and forming sodium chloride which is bonded to the filter material via the liquid salt layer.

The present invention is therefore a process for removing sodium from molten aluminum which has a dissolved content of sodium by passing the resulting mixture through a filter of inert refractory material which carries a liquid metal chloride salt coating. The coating chemisorbs aluminum chloride, with which the dissolved sodium reacts.

Salt mixtures which have chlorides of alkali and alkali earth metals as their main constituents are preferred for the liquid salt layer. There is also the possibility of lowering the melting point or of reaching a specific viscosity with the salt mixture by using a double salt of the kind $$Me(AlX_4) \text{ or } Me_3(AlX_6)$$

in which Me stands for alkali metal and X for fluorine or chlorine.

Furthermore it has been found advantageous to use refractory ceramic, preferably aluminum oxide ceramic, or refractory brick as the material to withstand the temperature of the treatment. If a ceramic is used as the filter bed, then the ceramic can be made in the form of granules or with foam. With a suitable refractory material there is the possibility of making the "substrate" in the form of a porous or channeled sheets or slabs or to assemble sheets of the material in the form of baffles.

It has been found, in particular in using ceramic foam material, that after a long time in service the pores can become blocked by the sodium chloride absorbed on the surface. It has been shown to be advantageous therefore to use the filter in a form in which it is made of several layers of foam with the pore size decreasing in the direction of flow of the liquid aluminum. The same effect, i.e. achieving longer service life from the filter, can be achieved with granular material by arranging the particle size of the granular material so that it decreases either continuously or in layers in the direction of flow of the aluminum melt.

The filter bed is preferably at least 5 cm thick e.g. 15 to 35 cm thick.

In order to prevent droplets of the molten salt being dragged out of the filter by the aluminum flowing through it, it has been found advantageous to cover the filter bed with a filter which physically blocks the passage of the droplets. In order to prevent the physical filter from being contaminated it is useful to pass the gas through the filter in the same direction as, and together with, the aluminum melt, i.e. the gas and the metal are introduced into the filter bed on the side away from the physical filter.

This co-current flow method has also been found to be of advantage even when no physical filter is used since it prevents contamination of the filtered melt with $AlCl_3$ or other reaction products.

The term "aluminum" as here employed means not only pure aluminum but also alloys which have aluminum as the main constituent.

Similarly the term "reactive chlorine" as here employed means not only elemental chlorine but also chlorine compounds which are in the gaseous form at the temperature of the treatment and which react with molten aluminum to form quantities of aluminum chloride. Such chlorine compounds are for example $C_2Cl_6$ and $CCl_4$. The term thus designates a gaseous chlorinating agent for molten aluminum.

In carrying out the process the filter bed or the liquid salt layer on the filter is activated, either periodically or continuously, with "reactive chlorine". It has been shown to be advantageous to pass a continuous stream of an inert gas, e.g. argon, through the melt co-currently with the flow of chlorine.

In treating alloys containing magnesium with the process of the invention there were initially some difficulties i.e. besides the sodium, magnesium too was removed from the melt. It was found that the removal of magnesium occurred via a reaction of the following kind viz., $$2Me^{I}AlCl_4 + 3Mg \rightarrow 2Me^{I}Cl + 3MgCl_2 + 2Al \quad ,$$

and that this can be avoided if $MgCl_2$ is present in the salt mixture as the main constituent. The $AlCl_3$ which results from flushing the melt with gas reacts with $MgCl_2$ to form a double salt which is in a thermodynamically favourable equilibrium with the magnesium dissolved in the melt.

The advantages of the process of the invention are described in greater detail by means of the following two examples.

EXAMPLE 1

A charge of 250 kg of an aluminum alloy containing 3% Mg and 20 ppm sodium was melted and held at a temperature of 690°–750° C. in an oil-fired furnace. The melt was then passed at a rate of 6 kg/min through a filter bed which was 20×20×20 cm in size, composed of $Al_2O_3$ ceramic of particle size 1.5 cm and coated with a salt mixture of 85% $MgCl_2$
15% NaCl applied by immersing the filter in the molten salt mixture of that composition.

Argon was continuously passed through the filter bed at a rate of 1 liter per minute, to which chlorine also at a rate of 1 liter per minute was added for intervals of 5 minutes every 10 minutes. Both gases were passed through the filter bed together with the molten aluminum i.e. co-current flow.

The sodium content of the aluminum alloy was thus reduced to an average value of 7.5 ppm, which corresponds to a purification of 62.5%. There was no decrease in the concentration of magnesium.

EXAMPLE 2

A 250 kg charge of 99.8% aluminum containing 35 ppm of sodium was melted in the same equipment and under the same conditions as in 1, except that the example filter bed was $Al_2O_3$ ceramic foam of dimensions 20×20×20 cm, coated by immersion in a concentrated aqueous solution of 40% NaCl
30% KCl
30% NaF and then dried at approx. 200° C., and the above described "active" filter bed was covered by a mechanical $Al_2O_3$foam filter 20×20×10 cm in size.

The sodium content of the aluminum was thereby decreased to 3 ppm, which corresponds to a purification of 91.4%.

What is claimed is:

1. An improved process for the removal of sodium impurities from molten aluminum and aluminum alloy melts comprising:

providing a filter medium;

coating said filter medium with a metal chloride salt coating so as to form an active surface on said filter medium;

fluxing said molten melt with reactive chlorine gas upstream of said filter medium so as to form aluminum chloride therein; and passing said molten melt through said filter medium wherein said aluminum chloride is chemisorbed on said active surface, the temperature of said molten melt being above the melting point of said active surface wherein said sodium impurities in said molten melt reacts with said chemisorbed aluminum chloride on said filter medium active surface so as to remove said sodium impurities from said molten melt such that said molten melt downstream of said filter medium is substantially free of said sodium impurities.

2. A process according to claim 1 wherein said active surface of said filter medium is provided on a refractory substrate.

3. A process according to claim 2 wherein said coating of said filter medium comprises immersing said refractory substrate in a concentrated aqueous solution of said metal chloride salt.

4. A process according to claim 3 wherein the metal chloride salt coating comprises a mixture selected from the group consisting of alkali metal and alkaline earth metal chlorides.

5. A process according to claim 2 wherein said metal chloride salt comprises a double salt of the formula $Me_3(AlX_6)$ or $Me(AlX_4)$ wherein Me stands for alkali metal and X for F or Cl.

6. A process according to claim 1 wherein said molten melt comprises an aluminum magnesium alloy and said metal chloride salt comprises magnesium chloride as a major component thereof.

7. A process according to claim 2 wherein said refractory substrate is aluminum oxide ceramic.

8. A process according to claim 7 wherein said ceramic is in granular form.

9. A process according to claim 8 wherein the particle size of the filter medium decreases layerwise or continuously in the direction of flow of the melt.

10. A process according to claim 2 wherein the ceramic is in the form of foam sheet.

11. A process according to claim 10 wherein the pore size of the ceramic foam sheet decreases layerwise or continuously in the direction of the flow of the melt.

12. A process according to claim 1 wherein said chemisorbent active surface of said filter medium is covered with a filter which physically filters the melt and prevents said metal chloride salts from clinging to said melt after said melt has contacted said active surface of said filter medium.

13. A process according to claim 1 wherein said metal chloride salt comprises at least in part sodium chloride.

* * * * *